US007481093B2

(12) United States Patent
Joseph

(10) Patent No.: US 7,481,093 B2
(45) Date of Patent: Jan. 27, 2009

(54) PUNCHING PROCESS WITH MAGNETOSTRICTIVE POWER SOURCE

(75) Inventor: J. Michael Joseph, Newport News, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 653 days.

(21) Appl. No.: 11/154,966

(22) Filed: Jun. 16, 2005

(65) Prior Publication Data

US 2006/0005674 A1 Jan. 12, 2006

Related U.S. Application Data

(60) Provisional application No. 60/581,275, filed on Jun. 18, 2004.

(51) Int. Cl.

| | |
|---|---|
| ***B21J 15/24*** | (2006.01) |
| ***B21D 28/00*** | (2006.01) |
| ***B21D 26/00*** | (2006.01) |
| ***B21B 25/00*** | (2006.01) |

(52) U.S. Cl. ..... 72/430; 72/333; 72/465.1; 72/466.9

(58) Field of Classification Search ..... 72/430, 72/707, 333, 458, 465.1, 466, 466.8, 466.9; 83/575–577

See application file for complete search history.

(56) References Cited

U.S. PATENT DOCUMENTS

| | | | | |
|---|---|---|---|---|
| 3,874,207 | A * | 4/1975 | Lemelson | 72/56 |
| 4,621,772 | A * | 11/1986 | Blythe et al. | 239/585.4 |
| 4,854,024 | A * | 8/1989 | Grieb et al. | 29/890.132 |
| 5,205,147 | A * | 4/1993 | Wada et al. | 72/429 |
| 5,245,904 | A * | 9/1993 | Meyerle | 83/529 |
| 6,570,474 | B2 | 5/2003 | Czimmek | 335/215 |
| 6,720,684 | B2 | 4/2004 | Czimmek | 310/26 |
| 6,968,723 | B2 * | 11/2005 | Akahane et al. | 72/334 |

FOREIGN PATENT DOCUMENTS

| | | | |
|---|---|---|---|
| JP | 05185292 | A * | 7/1993 |
| JP | 05200446 | A * | 8/1993 |

OTHER PUBLICATIONS

Translation of JP 05-185292.*
Translation of JP 05-200446.*

* cited by examiner

*Primary Examiner*—Dana Ross
*Assistant Examiner*—Teresa Bonk

(57) ABSTRACT

A method and assembly for punching a hole in material provided. A magnetostrictive device 14 includes a coil 26, a magnetostrictive member 22, and a punch 28 operatively associated with the magnetostrictive member 22. The magnetostrictive member 22 is constructed and arranged to lengthen, when exposed to a magnetic field created by the coil 26, thereby moving the punch 28. Material 12 to be punched is associated with the punch 28. The coil is energized to create a magnetic field and thus lengthen the magnetostrictive member 22 so that the punch 28 moves through the material 12, creating a hole in the material 12.

17 Claims, 2 Drawing Sheets

PUNCHING PROCESS WITH MAGNETOSTRICTIVE POWER SOURCE

This application is claims the benefit of U.S. Provisional Application No. 60/581,275, filed on Jun. 18, 2004, which is hereby incorporated by reference in its entirety.

FIELD OF THE INVENTION

This invention relates to punching small orifice holes and, more particularly, to the use of a magnetostrictive device as the driving force for punching orifice holes into an orifice disc that is used for fuel injectors.

BACKGROUND OF THE INVENTION

Conventional devices for supplying the force to punch orifice holes in an orifice disc used for a fuel injector include mechanical presses, air cylinders, air/oil cylinders, hydraulic cylinders, and electromagnetic solenoids. Except for the electromagnetic solenoid, these devices deliver the driving force at a relatively slow velocity. The disadvantage of using an electromagnetic solenoid is that it is physically large and not compact as is necessary for driving individual punches.

Thus, there is a need to provide a cost-effective, high-velocity and compact device as the driving force for moving an individual punch in making holes, such as orifice holes in an orifice disc.

SUMMARY OF THE INVENTION

An object of the invention is to fulfill the need referred to above. In accordance with the principles of the present invention, this objective is achieved by a method for punching a hole in material. A magnetostrictive device is provided and includes a coil, a magnetostrictive member, and a punch operatively associated with the magnetostrictive member. The magnetostrictive member is constructed and arranged to lengthen, when exposed to a magnetic field created by the coil, thereby moving the punch. Material to be punched is associated with the punch. The coil is energized to create a magnetic field and thus lengthen the magnetostrictive member so that the punch moves through the material, creating a hole in the material.

In accordance with another aspect of the invention, a punch assembly includes a die constructed and arranged to support material to be punched. A magnetostrictive device includes a coil, a magnetostrictive member, and a punch operatively associated with the magnetostrictive member. The magnetostrictive member is constructed and arranged to lengthen when exposed to a magnetic field created by the coil. When the coil is energized and the magnetostrictive member lengthens, the punch moves through the material and into the die, thereby creating a hole in the material.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
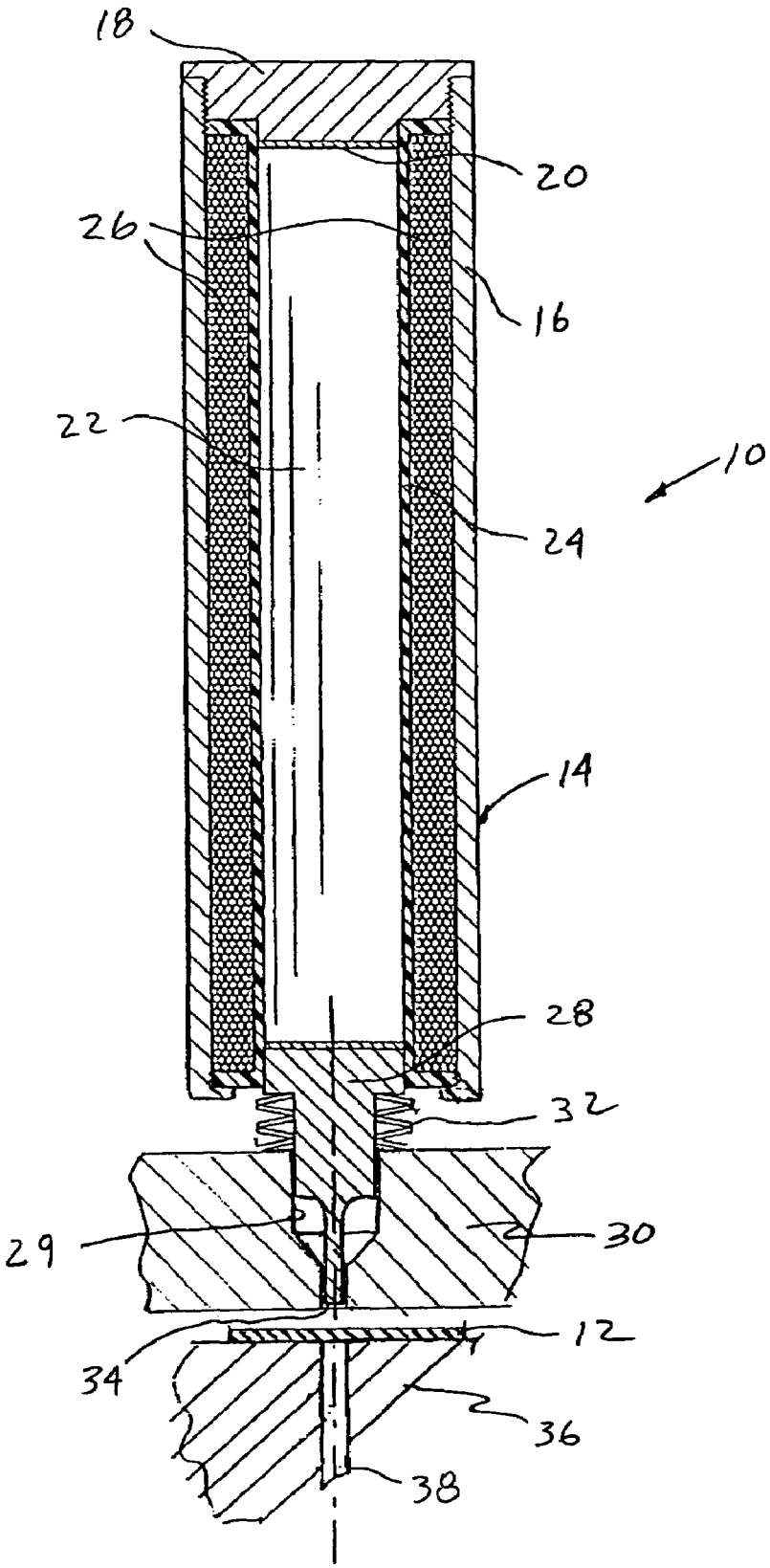
FIG. 1 is a schematic illustration of punch assembly including a magnetostrictive device as a driving force for a punch to punch a hole in material in accordance with the principles of the present invention.

With reference to FIG. 1, a punch assembly, generally indicated at 10, is shown for punching small holes in material 12. The punch assembly 10 includes a magnetostrictive device, generally indicated at 14, of the type for example, as disclosed in U.S. Pat. No. 6,570,474 B2, the contents of which is hereby incorporated by reference in its entirety into this specification. In the embodiment, the magnetostrictive device 14 includes a steel cylindrical housing 16. A threaded magnetic steel end cap 18 at the distal end of the cylindrical housing 16 supports a soft steel shim 20. A magnetostrictive member 22, preferably of Terfenol-D, is coaxially positioned within both the housing 16 and a cylindrical polymer bobbin 24, such that the distal end of the magnetostrictive member 22 is in contact with the soft steel shim 20. A coil 26 is provided about the bobbin 24, the function of which will be explained below.

The assembly 10 includes a hardened magnetic steel piston 28, defining a punch, moveably positioned at the proximal end of the magnetostrictive member 22 within a bore 29 of a conventional punch holder/stripper plate 30. A return spring 32 urges the piston 28 into contact with the proximal end of the magnetostrictive member 22, thereby exerting a preload on the magnetostrictive member 22. The spring 32 is provided between a surface of the piston 28 and a surface of the punch holder/stripper plate 30. According to a presently preferred embodiment, the magnetostrictive member 22 should be prestressed to a nominal value (i.e., about 7.6 MPa for Terfenol-D) to maximize magnetostriction. This prestress is preferably provided by a high spring rate disc spring 32 (e.g., chrome-vanadium steel belleville springs) chosen and stressed to optimize their cycle life.

In operation, the steel piston 28 moves downwardly under a force exerted by the magnetostrictive member 22 due to the magnetostrictive member 22 lengthening as a result of being exposed to a magnetic field created by energizing the coil 26. Thus, the end 34 of the piston 28 punches a hole through the material 12 that is supported by a die 36. After punching the hole in the material 12, the end 34 of the piston 28 is received in a bore 38 in the die 36. The punch holder/stripper plate 30 guides the punch and also holds the material 12 down as the punch 28 is pulled out. The bore 38 and the end 34 of the piston 28 are preferably round to create circular holes, but they can be of any configuration to produce the desired shaped hole in the material 12. When current is removed from the coil 26, the magnetostrictive member 22 returns to its original, unstretched length. The lengthening and contraction of the magnetostrictive member 22 can occur in milliseconds.

The punch assembly 10 is particularly useful in the manufacture of orifice discs (e.g. material 12 in FIG. 1) for the use in fuel injectors, but can be used in punching holes in any material. Holes in an orifice disc range in size from about 0.100 mm to about 0.300 mm or more, but are unlikely to exceed 0.600 mm in multi-hole orifice discs. The thickness of the material 12 used in the manufacturing of orifice discs typically range from 0.076 mm to 0.203 mm. However, in some applications, the thickness of the material 12 can be 0.254 mm or 0.300 mm. The punch assembly 10 can be arranged to punch angled holes (e.g., 20 degrees and up to about 45 degrees) in the material 12. The magnetostrictive device 14 will operate in these ranges and can be configured to extend its operating range by using a 2:1 or 3:1 hydraulic or mechanical amplifier.

Figure 2:
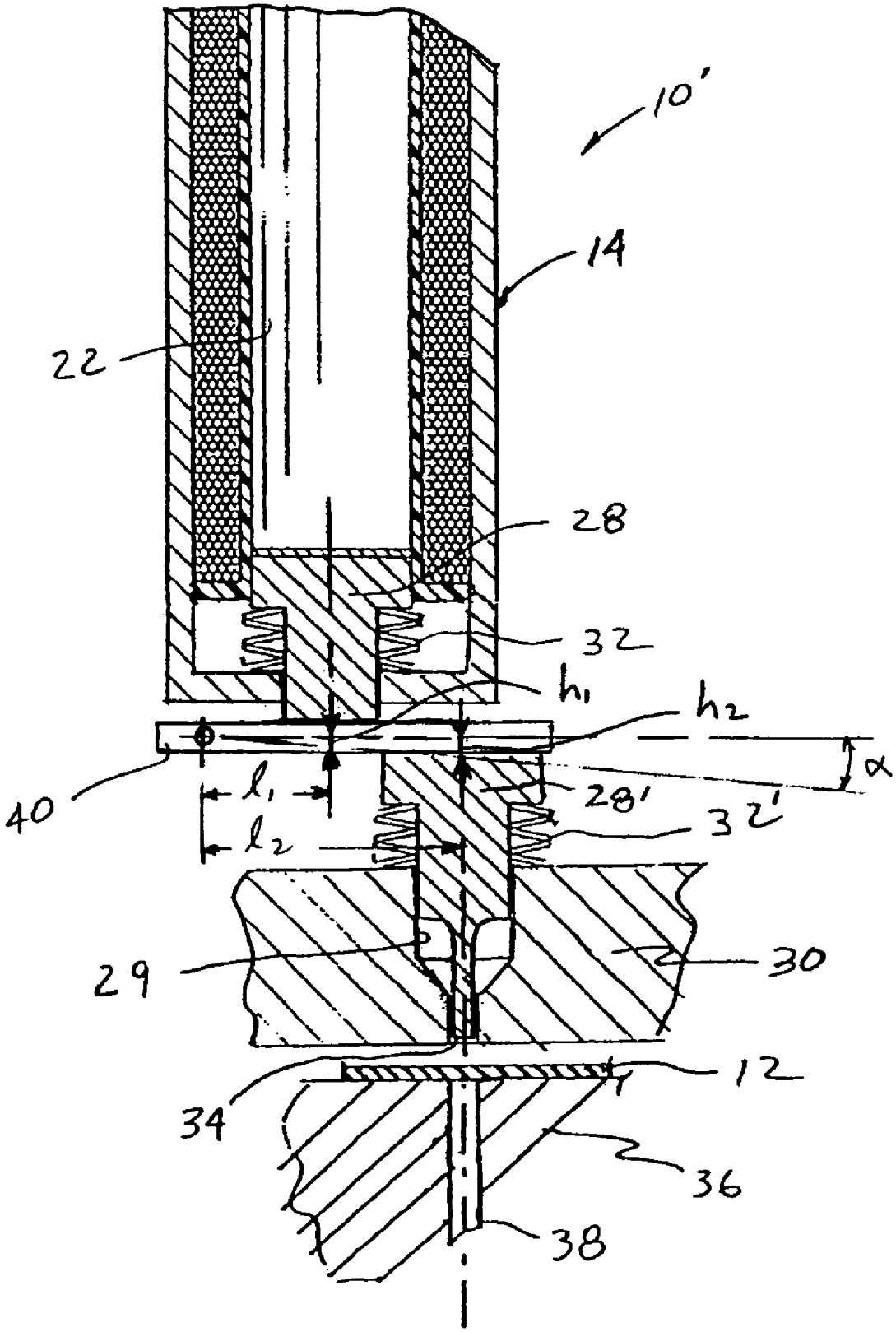
FIG. 2 is a schematic illustration of punch assembly according to another embodiment of the invention, including a mechanical amplifier.

FIG. 2 shows a pump assembly 10' in accordance with another embodiment of the invention. In order to increase punch travel, the assembly 10' includes a pivoting mechanical lever 40 as a mechanical amplifier between portions 28 and 28' of the punch. A second spring 32' is provided between portion 28' of the punch and the punch holder/stripper plate 30. With reference to FIG. 2, $\alpha$ is the angular displacement of the lever 40 and, for any given $\alpha$, the following relationship is defined:

$$l_1/h_1=l_2/h_2$$

The magnetization force, and therefore the amount of stretching of the magnetostrictive member 22, is determined primarily by the current in coil 26 and number of coil turns. The number of coil turns may be calculated or experimentally determined for a given configuration. The coil current should be maintained within a reasonable range that would avoid saturating the magnetostrictive material or dissipating excessive power in the coil. In a preferred embodiment, the current can be varied by an external driver or determined from the operating voltage and coil resistance.

By using the magnetostrictive device 14 to drive an individual punch 28 in the punch assembly 10, the benefits of high velocity and compactness can be realized in making orifice holes in an orifice disc. The high velocity, (i.e., 3000 strokes per minute) makes a cleaner hole, results in better tool life, yields a more stable process in making orifice disc which will yield orifice discs with less variance.

The term "magnetostriction" literally means magnetic contraction, but is generally understood to encompass the following similar effects associated with ferromagnetic materials: the Guillemin Effect, which is the tendency of a bent ferromagnetic rod to straighten in a longitudinal magnetic field; the Wiedemann Effect, which is the twisting of a rod carrying an electric current when placed in a magnetic field; the Joule Effect, which is a gradual increasing of length of a ferromagnetic rod when subjected to a gradual increasing longitudinal magnetic field; and the Villari Effect, which is a change of magnetic induction in the presence of a longitudinal magnetic field (Inverse Joule Effect).

While the present invention is described primarily with reference to Terfenol-D as a preferred magnetostrictive material, it will be appreciated by those skilled in the art that other alloys having similar magnetostrictive properties may be substituted and are included within the scope of the present invention. Furthermore, permanent magnets (not shown) can be employed to bias the Terfenol-D magnetic domains in various coil combinations.

Control of the punch assembly 10, 10' can be achieved, for example, with the control strategy disclosed in U.S. Pat. No. 6,720,684, the contents of which is hereby incorporated by reference in its entirety into this specification.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A punch assembly comprising:

a die constructed and arranged to support material to be punched, a magnetostrictive device including a coil, a magnetostrictive member, and a punch operatively associated with the magnetostrictive member, the magnetostrictive member being constructed and arranged to lengthen when exposed to a magnetic field created by the coil, the punch including first and second portions, each portion having an axis, the axes being offset from each other, and a mechanical amplifier in the form of a pivoting mechanical lever disposed between the first and second portions of the punch and constructed and arranged to increase travel of the second portion of the punch, whereby, when the coil is energized and the magnetostrictive member lengthens, the first portion of the punch engages the lever causing the lever to pivot and engage the second portion of the punch with the second portion of the punch moving through the material and into the die, thereby creating a hole in the material.

2. The punch assembly of claim 1, further comprising a plate associated with the punch and the material to be punched, the plate having a bore there through, a portion of the punch being received for movement within the bore of the plate.

3. The punch assembly of claim 2, further comprising a spring between a surface of the punch and a surface of the plate, the spring being constructed arranged to prestress the magnetostrictive member.

4. The punch assembly of claim 1, in combination with the material to be punched, the material to be punched being an orifice disc of a fuel injector.

5. The punch assembly of claim 4, wherein the punch is constructed and arranged to punch holes in the orifice disc in a range generally between 0.100 mm and 0.600 mm.

6. The punch assembly of claim 4, wherein the punch is constructed and arranged to punch holes in the orifice disc in a range generally between 0.100 mm and 0.300 mm.

7. The punch assembly of claim 1, wherein the punch is constructed and arranged to punch holes in a range generally between 0.100 mm and 0.600 mm.

8. The punch assembly of claim 1, wherein the magnetostrictive member comprises Terfenol-D.

9. A punch assembly comprising:

a punch having first and second portions, the second portion being constructed and arranged to punch a hole in material, each portion having an axis, the axes being offset from each other, a mechanical amplifier in the form of a pivoting mechanical lever disposed between the first and second portions of the punch and constructed and arranged to increase travel of the second portion of the punch, and magnetostrictive means, operatively associated with the first portion of the punch, for moving the first portion of the punch into engagement with the lever causing the lever to pivot and engage the second portion of the punch thereby causing the second portion of the punch to punch a hole in the material, upon exposure of the magnetostrictive means to a magnetic field.

10. The punch assembly of claim 9, in combination with the material, wherein the material is an orifice disc of a fuel injector.

11. The punch assembly of claim 10, wherein the punch is constructed and arranged to punch holes in orifice disc in a range generally between 0.100 mm and 0.600 mm.

12. The punch assembly of claim 9, wherein the magnetostrictive means includes a magnetostrictive member comprising Terfenol-D.

13. A method of punching a hole in material including:

providing a magnetostrictive device including a coil, a magnetostrictive member, a punch operatively associated with the magnetostrictive member, the punch having first and second portions, each portion having an axis, the axes being offset from each other, and a mechanical amplifier in the form of a pivoting mechanical lever disposed between the first and second portions of the punch, the magnetostrictive member being constructed and arranged to lengthen, when exposed to a magnetic field created by the coil, associating material to be punched with the second portion of the punch, and energizing the coil to create a magnetic field and thus lengthen the magnetostrictive member causing the first portion of the punch to engage the lever causing the lever to pivot and engage the second portion of the punch with the second portion of the punch moving through the material, creating a hole in the material.

14. The method of claim 13, wherein the step of associating the material includes placing an orifice disc of a fuel injector on a die.

15. The method of claim 13, wherein the magnetostrictive member comprises Terfenol-D.

16. The method of claim 14, wherein the hole created in the orifice disc is in a size range generally between 0.100 mm and 0.600 mm.

17. The method of claim 13, further including prestressing the magnetostrictive member prior to energizing the coil.

* * * * *